United States Patent [19]

Mastrodicasa

[11] Patent Number: 4,658,969

[45] Date of Patent: Apr. 21, 1987

[54] ADJUSTABLE BRACKET ASSEMBLY FOR SUPPORTING A SHELF

[76] Inventor: Arthur R. Mastrodicasa, 5 Elmcrest Cir., Walpole, Mass. 02081

[21] Appl. No.: 860,998

[22] Filed: May 8, 1986

Related U.S. Application Data

[63] Continuation of Ser. No. 763,643, Aug. 8, 1985, abandoned, which is a continuation of Ser. No. 593,665, Mar. 26, 1984.

[51] Int. Cl.[4] ..... A47G 29/02

[52] U.S. Cl. ..... 211/187; 211/153; 248/250

[58] Field of Search ..... 248/250, 241, 187, 235, 248/310, 243, 242; 108/108; 211/134, 186, 187, 153; 403/328; 292/264

[56] References Cited

U.S. PATENT DOCUMENTS

| | | | |
|---|---|---|---|
| 826,321 | 7/1906 | Eustis | 248/250 |
| 1,176,588 | 3/1916 | Miller et al. | 248/250 |
| 1,230,999 | 6/1917 | Crist | 248/250 |
| 1,702,937 | 2/1929 | Friedemann | 248/250 X |
| 1,779,236 | 10/1930 | Hoegger . | |
| 2,136,109 | 11/1938 | Kress | 248/125 |
| 2,673,109 | 3/1954 | Frost | 292/150 X |
| 3,321,089 | 5/1967 | Krikorian | 211/134 |
| 3,353,684 | 11/1967 | Chesley | 211/176 |
| 3,355,134 | 11/1967 | Chesley | 248/250 |
| 3,565,381 | 2/1971 | Oliver | 248/243 |
| 4,518,002 | 5/1985 | Battison, Sr. et al. | 403/328 X |

FOREIGN PATENT DOCUMENTS

| | | | |
|---|---|---|---|
| 601755 | 7/1960 | Canada | 108/108 |
| 299250 | 6/1962 | France | 248/250 |
| 414757 | 8/1934 | United Kingdom | 248/241 |

*Primary Examiner*—Ramon S. Britts
*Assistant Examiner*—Karen J. Chotkowski
*Attorney, Agent, or Firm*—Scott R. Foster

[57] ABSTRACT

A bracket assembly and shelf wherein the bracket assembly comprises an adjustable bracket assembly for supporting the shelf. The assembly includes a bracket member having a recess therein for receiving a shelf first portion, a slide member moveably mounted on the bracket member and having a recess therein for receiving a shelf second portion, and a lock means between the bracket and slide member for locking together and variably positioning the bracket and slide members relative to one another.

1 Claim, 4 Drawing Figures

ADJUSTABLE BRACKET ASSEMBLY FOR SUPPORTING A SHELF

This is a continuation of application Ser. No. 763,643, filed Aug. 8, 1985, now abandoned, which is a continuation of Ser. No. 593,665, filed Mar. 26, 1984, now abandoned.

BACKGROUND OF THE INVENTION

1. Field of the Invention

This invention relates to shelf-supporting devices and is directed more particularly to an adjustable bracket assembly adapted to securely support shelving of various sizes and configurations.

2. Description of the Prior Art

Shelf-supporting brackets of the type finding utility in retail outlets are generally well known and various embodiments are adapted to operate under given conditions.

U.S. Pat. No. 3,321,089, issued May 23, 1967 to G. Krikorian is illustrative of a shelf-supporting bracket comprising an arm having notches therein suited for receiving flexible wires of a wire $helf. Other examples of brackets adapted for use with wire shelving include U.S. Pat. No. 3,355,134, issued Nov. 28, 1967 to R. G. Chesley, and U.S. Pat. No. 3,565,381, issued Feb. 23, 1971 to Earl. J. Oliver, both of which show the use of fasteners, or clamps, on bracket members to secure wire portions of shelving thereto. The fasteners may be moved about upon the brackets to provide for adjustability and thereby attain a degree of usefulness not found in the Krikorian device.

Other embodiments of adjustable shelf supports are found in

U.S. Pat. No. 1,702,937, issued Feb. 19, 1929 to M. M. Friedemann, and U.S. Pat. No. 1,779,236, issued Oct. 21, 1930 to J. A. Hoegger. In Friedemann, a slide member is mounted on a bracket arm and used in conjunction with an "angle member" to squeeze opposite edges of a shelf therebetween. The bracket arm and angle member are both mounted upon a vertical standard. In Hoegger, a shelf supporting arm has a notch on its upper edge, and a spring-biased extension protruding from the free end thereof, the extension having a notch opposed to the arm notch, such that a shelf may be gripped at opposite edges by the two notches, under a spring bias. Neither Friedemanh nor Hoeffer is directed specifically to wire shelving.

SUMMARY OF THE INVENTION

An object of the present invention is to provide an adjustable bracket assembly for use with shelving, and particularly for use with wire shelving of various configurations.

Another object of the invention is to provide such an assembly as may be used with wire shelving in which the wires are substantially rigid and lacking in flexibility.

A further object of the invention is to provide such an assembly as may be used independently of additional structures, such as angle members, fasteners, clamps, and the like.

A still further object of the invention is to provide such an assembly which, though adjustable, is completely secure in its shelf-retaining function.

A still further object of the invention is to provide such an assembly which, though strong and durable, is readily manufactured inexpensively and which, in the market place, is easy and safe to use.

With the above and other objects in view, as will hereinafter appear, a feature of the present invention is the provision of a bracket assembly for supporting a shelf, the assembly comprising a bracket member, the bracket member having a first recess therein, the first recess being adapted to receive a shelf first portion therein. a slide member mounted on the bracket member, the slide member having a second recess therein, the second recess being adapted to receive a shelf second portion therein, the slide member being slidably moveable upon the bracket member to selectively determine spacing between the first and second recesses, and a lock means interconnecting the bracket member and the slide member for securing the slide member in a selected fixed position on the bracket member, such that the first and second recesses exert a fixed holding pressure on the shelf first and second portions.

The above and other features of the invention, including various novel details of construction and combinations of parts, will now be more particularly described with reference to the accompanying drawngs and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention from which its novel features and advantages will be apparent.

In the drawings.

DESCRIPTION OF THE PREFERRED EMBODIMENT

Figure 1:
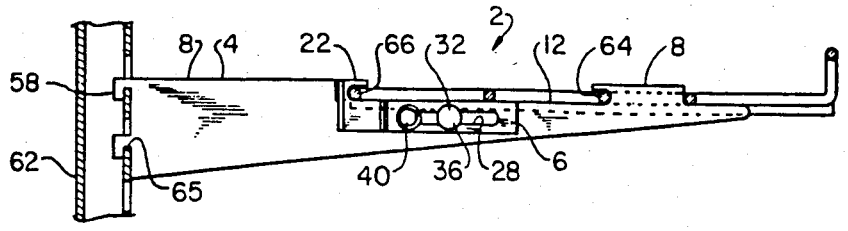
FIG. 1 is a side elevational view of one form of bracket assembly illustrative of an embodiment of the invention, shown in combination with an upright support and wire shelf, the latter elements shown in section for clarity.

Referring to the drawings, it will be seen that the illustrative bracket assembly 2 includes a bracket member 4 and a slide member 6 mounted on the bracket member.

Figure 3:
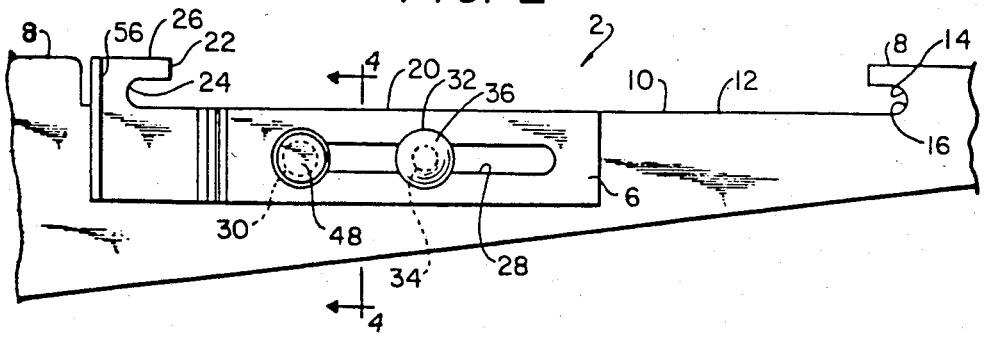
FIG. 3 is an enlarged side elevational view of the assembly.
Figure 4:
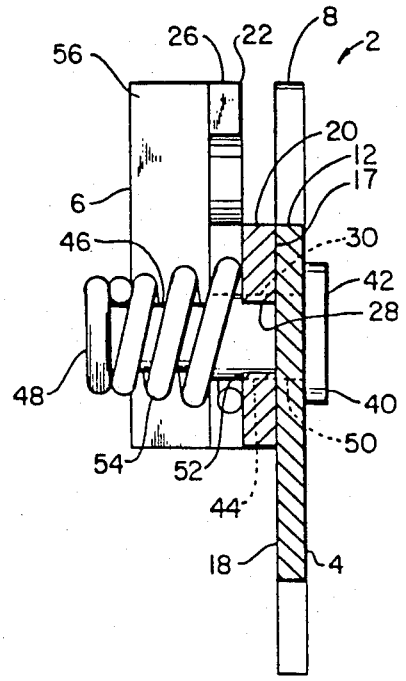
FIG. 4 is a sectional view of the bracket assembly taken along line 4—4 of FIG. 3.

The bracket member 4 comprises a rigid, elongated, substantially planar member, preferably of metal. A first lengthwise edge 8 of the bracket member, the upper edge as viewed in the drawings, is provided with an elongated notch 10 having a lengthwise edge 12 spaced inwardly of the bracket member from the edge 8. A first end 14 of the notch 10 forms a first recess 16, the first recess extending, as shown in FIG. 3, beneath the bracket member edge 8, but proximate thereto. The slide member 6 (FIG. 3) comprises a rigid, elongated member, preferably of metal, having a planar portion 17 (FIG. 4) disposed adjacent a surface 18 of the bracket member 4 and slidable thereon. The slide member 6 is provided with a recessed edge 20 disposed coincidentally with the bracket member notch lengthwise edge 12 (FIGS. 3 and 4), and a hook portion 22 upstanding from the slide member recessed edge 20 to form a second recess 24. An upper edge 26 of the hook portion 22 is substantially coincident with the bracket member lengthwise edge 8. The second recess 24 extends beneath the hook portion upper edge 26, but is proximate thereto. The first and second recesses 16, 24 are thus in alignment with each other and preferably opposed.

The slide member planar portion 17 is provided with opening means, preferably in the form of an elongated slot 28 having an enlarged portion 30 at one end thereof. A first pin 32 is fixed to the bracket member 4, a shank portion 34 of the pin 32 extending through the slot 28. The first pin 32 is provided with a head 36 larger than the width of the slot 28, to retain in a slidable mode the slide member 6 upon the bracket member surface 18.

A second pin 40 is mounted in the assembly. The second pin 40 includes a first enlarged head 42, a first enlarged shank portion 44, a second shank portion 46 and a second enlarged head 48. The second pin 40 is disposed in a hole 50 in the bracket member 4, the hole 50 being only slightly larger in diameter than the second pin enlarged first shank portion 44, but smaller in diameter than the second pin first head 42. The second pin first enlarged shank portion 44 is also larger in diameter than the width of the slot 28, but slightly smaller than the enlarged portion 30 of the slot 28. The second shank portion 46 of the pin 40 extends through the slot 28 and is joined to the second head 48. A coil spring 54 is disposed between the head 48 and the slide member 6 and biases an edge 52 of the shank portion 44 firmly against slide member 6 to hold the members 4, 6 together.

If the slide member 6 is moved to the right, as viewed in the drawings, to a point at which the second pin first enlarged shank portion 44 is in alignment with the slot enlarged portion 30, the shank portion 44 will be caused by the coil spring 54 to snap into the enlarged slot portion, to securely lock the bracket member 4 and slide member 6 together.

The slide member 6 preferably is provided with a grip portion 56 extending outwardly from the bracket member at an angle to the plane of the slide member planar portion 17.

The bracket member 4 is preferably provided with tab portions 58 integral with an end of the bracket member for engaging holes 65 in a support member 62 and thereby connecting the bracket member to the support member (FIG. 1).

Figure 2:
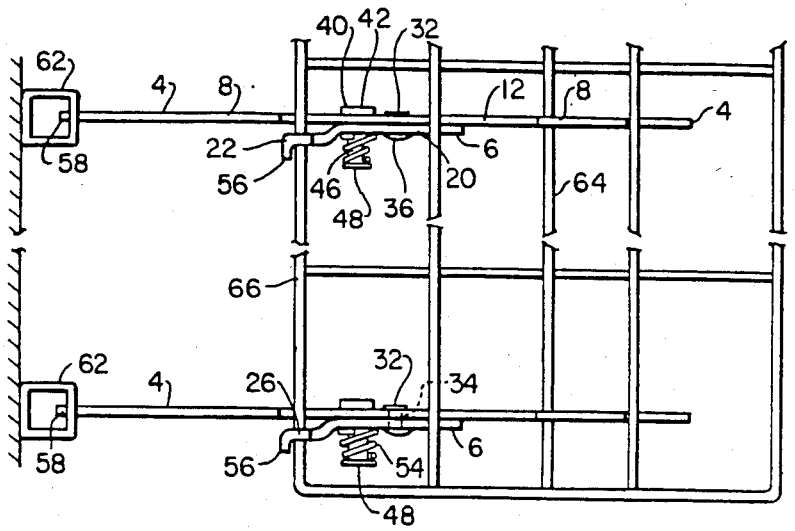
FIG. 2 is a top plan view of the elements shown in FIG. 1.

The illustrative invention, as above described, is ideally suited for use in combination with shelves of the wire type, with which the assembly is illustrated in FIGS. 1 and 2. As may be seen, the first recess 16 is adapted to receive a shelf first portion, such as a wire 64, and the second recess 24 is adapted to receive a shelf second portion, such as a wire 66. Upon manual depression of the head 48, the slide member 6 is slidably moveable on the bracket member 4 to selectively determine the spacing between the first and second recesses 16, 24. Upon releasing the head 48, the slide member is held against the bracket member in a selected position, such that the first and second recesses retain the shelf first and second portions, or wires 64, 66.

The pressure of the spring 54 is sufficient to permit usage of the assembly for a variety of wire spacings. However, it is intended that the assembly be provided for use with shelving having known wire spacing. It is preferable that the spacing of two wires of the shelving coincide with the spacing of the first and second recesses 16, 24 when the slide member 6 is fully to the right as viewed in the drawings. In that position, the second pin enlarged shank portion 44 enters the slot enlarged portion 30, thereby positively locking the members 4, 6 together with the wires 64, 66 captured in the recesses 16, 24.

It will be apparent that in the locked position, the shelf first wire 64, disposed in the first recess 16, is blocked from moving in any but a first direction, toward the support member 62, and that the shelf second wire 66, disposed in the second recess 24, is blocked from movement in any but a second direction, away from the support member 62. Thus, inadvertent dislodging of the shelf from the assembly is prevented.

If it is desired to change to a shelf having a different wire spacing, an operator need only depress the locking pin head 48, slide the slide member 6 to a releasing position and remove the shelf. Wire portions of a new shelf can then be inserted between the recesses 16, 24, the slide member 4 moved to a position in which holding pressure is exerted on the wires disposed in the first and second recesses, and locked in place by releasing the locking pin head 48.

It is to be understood that the present invention is by no means limited to the particular construction herein disclosed and/or shown in the drawings, but also comprises any modifications or equivalents within the scope of the disclosure.

Having thus described my invention what I claim as new and desire to secure by Letters Patent of the United States is:

1. In combination, a bracket assembly and a shelf, said bracket assembly comprising a main flat bracket member, said main bracket member being a rigid, elongated substantially flat member having upper and lower edge surfaces, said main bracket member having a first hook-like projection on its upper surface proximate a first end of said main bracket member engaging a first shelf portion, said main bracket member having a portion of its upper surface extending beyond said first hook-like projection forming a supporting surface for said shelf, said main bracket member having means at a second end thereof for attaching said main bracket member to a vertical support, a slide member mounted on said main bracket member for movement therealong, said slide member comprising a rigid, elongated member having a flat portion disposed vertically adjacent said flat bracket member between its upper and lower surfaces, said slide member having a second upstanding hook-like projection generally opposed to said first hook-like projection, said second hook-like projection receiving a second shelf portion therein, said slide member being slidably movable along said main bracket member to selectively determine spacing between said first and second hook-like projections, said slide member flat portion having an elongated slot therein, said slot having an enlarged portion therein, a first pin fixed to said flat main bracket member, a shank portion of said first pin extending through said slot, a head at the free end of said shank portion, said head having a diameter larger than the width of said slot enlarged portion to retain said slide member slidably on said main bracket member, and a second pin mounted in the assembly, said second pin comprising a first enlarged head disposed on the side of said main bracket member removed from said slide member, a first enlarged shank portion extending from said first enlarged head, said first enlarged shank portion having a diameter slightly smaller than the width of said slot enlarged portion and greater than the width of said elongated slot, a smaller shank portion extending from said enlarged shank portion and of lesser diameter than said enlarged shank portion and of a diameter slightly less than the width of said elongated slot, said smaller shank portion being adapted to extend through said slot, and a second enlarged head fixed to the end of said second pin remote from said first enlarged head, a spring mounted between said second enlarged head and said slide member, whereby said enlarged shank portion is adapted to enter said slot enlarged portion and urged by said spring to remain in said slot enlarged portion to lock said slide member in a fixed position along said main bracket member, and said enlarged shank portion being provided with a shoulder which is urgable by said spring into forceful engagement with the margins of said slot to secure said slide member on said main bracket member at locations in which said second pin enlarged shank portion is disposed along said slot out of alignment with said slot enlarged portion, said second pin further comprising a lock means interconnecting said main bracket member and said slide member for securing said slide member in a selected fixed position along said main bracket member, such that said first and second hook-like projections retain said shelf at its first and second portions.

* * * * *